United States Patent [19]

Murray et al.

[11] Patent Number: 4,919,065

[45] Date of Patent: Apr. 24, 1990

[54] SUBMARINE VEHICLE INTENDED TO MEASURE DATA AT THE DEEP OCEAN SEA-BOTTOM

[75] Inventors: Charles N. Murray, Ispra; Michel R. Jamet, Angera, both of Italy

[73] Assignee: European Atomic Energy Community (EURATOM), Luxembourg

[21] Appl. No.: 305,579

[22] Filed: Feb. 3, 1989

[30] Foreign Application Priority Data

Feb. 3, 1988 [LU] Luxembourg ..... 87126

[51] Int. Cl.[5] ..... E21B 15/02

[52] U.S. Cl. ..... 114/312; 175/8; 405/226; 52/165

[58] Field of Search ..... 114/294, 295, 297, 312, 114/337; 175/8, 9; 405/224, 226, 195; 181/101, 110, 402; 367/3, 4, 2, 15; 166/338; 52/155, 156, 165; 441/7, 21, 27, 30, 32, 33

[56] References Cited

U.S. PATENT DOCUMENTS

| | | | |
|---|---|---|---|
| 3,063,507 | 11/1962 | O'Neill | 175/8 |
| 3,187,705 | 6/1965 | Costello | 114/294 |
| 3,602,320 | 8/1971 | Howard | 175/8 |
| 3,635,183 | 1/1972 | Ureatinge | 114/312 |
| 3,642,063 | 2/1972 | Jergins | 175/9 |
| 3,672,177 | 6/1972 | Manning | 175/9 |
| 3,987,638 | 10/1976 | Buruhardt | 175/9 |
| 4,010,798 | 3/1977 | Corinet | 175/9 |
| 4,149,818 | 4/1979 | Hettinger | 114/312 |
| 4,686,927 | 8/1987 | Hawkes | 114/312 |

OTHER PUBLICATIONS

*IEEE Journal of Oceanic Engineering, vol. OE-10, No. 1, Jan. 1985, pp. 38-39, IEEE, New York, US; C. N. Murray et al.: "Parametric Analysis of Performances of Free-Fall Penetrators in Deep-Ocean Sediments", *pp. 40, 44*.

*Oil & Gas Journal, vol. 80, No. 32, Aug. 1982, p. 79, Tulsa, Oklahoma, US; "Sandia Sees Seabed Penetrator as Aid to Offshore Operations".

*Primary Examiner*—Joseph F. Peters, Jr.
*Assistant Examiner*—Clifford T. Bartz
*Attorney, Agent, or Firm*—Sughrue, Mion, Zinn, Macpeak & Seas

[57] ABSTRACT

The invention is related to a submarine vehicle for the deep ocean research. This vehicle is composed of a penetrator (1) and of a support structure (2 to 7). The vehicle descends by gravity due to a ballast disposed in the lower part (11) of the penetrator. Apart from this ballast, the vehicle can be recovered due to a discoupling of the ballast by an explosive bolt (13). After discoupling, the float clusters (8) located in the upper part of said support structure supply the mounting thrust necessary for transferring the vehicle up to the ocean surface. If this thrust is insufficient, a pyrotechnical device (15) can be provided, which inflates a bag and thus creates an additional thrust directed to the upside.

The invention is particularly useful in the investigation at the deep ocean sea-bottom.

4 Claims, 2 Drawing Sheets

SUBMARINE VEHICLE INTENDED TO MEASURE DATA AT THE DEEP OCEAN SEA-BOTTOM

FIELD OF THE INVENTION

The invention concerns a submarine vehicle for measuring data at the deep ocean sea-bottom, comprising a penetrator conceived to penetrate by gravity into the sediment at the sea-bottom.

BACKGROUND OF THE INVENTION

In order to study phenomena happening in the sea-bottom sediments, capsules have been conceived in the past which bear instruments and which were attached to a cable along which they were transferred down to the sea-bottom. After arriving there, the capsule took a sediment sample which was then mounted up to the ocean surface.

It has further been proposed to use for this purpose a submarine vehicle with or without an operator on board, this vehicle being guided down to the site where the samples were to be taken. Unfortunately, these two methods can be applied down to a restricted ocean depth only and are not suited for a long-term investigation. Moreover, these methods do not allow to implant measuring instruments inside the sediment.

The document IEEE Journal of Oceanic Engineering, vol. OE-10, No. 1, January 1985, pages 38 to 49, suggests to use free penetrators which fall by gravity to the sea-bottom and penetrate into the sediments for collecting measuring data therefrom. These data are then transmitted to the ocean surface through an ultrasound transmission channel. According to this paper, it seems possible to define in advance the penetration depth of the penetrator into a given sea-bottom sediment. A drawback of such a penetrator is constituted by the fact that it remains definitively in the sediment and that its instrumentation cannot be retrieved at the end of the investigation phase. This drawback is particularly cumbersome if the penetrator does not reach its correct measuring position after its gravity descent, be it that it has not reached the desired site, or that it entered incorrectly, for example obliquely.

SUMMARY OF THE INVENTION

The invention aims to eliminate these drawbacks and to propose a submarine vehicle such as specified above, which allows to be mounted up again to the ocean surface and thus to be recovered.

This aim is achieved according to the invention by a submarine vehicle such as specified above, which further comprises a support structure having a vertical axis and a plurality of float clusters disposed regularly around the axis of the support structure at the upper portion thereof, the penetrator being mounted at the lower end of said support structure and coaxially therewith, the penetrator being conceived to be divided into two cylindrical parts by means of a remotely controlled discoupling means, the lower one of said parts having a rounded end portion intended to penetrate into the sea-bottom and to constitute a ballast such that the vehicle may descend by gravity and at a given speed to the sea-bottom, whereas the upper one of said penetrator parts is conceived to receive a device for measuring data in the sediment, a transmitter/receiver for ultrasound signals being mounted between the float clusters in the upper portion of the support structure and being conceived to cooperate with a similar transmitter/-receiver at the free ocean surface, in order to transmit measuring data thereto and to receive control data therefrom, for example control data for discoupling the two parts of the penetrator.

According to a preferred embodiment of the invention, a horizontal disk is welded to the upper end of said penetrator and serves as an end stop for the penetration movement of the vehicle into the sediments.

Preferably, a remotely controlled pyrotechnical device is associated to the upper portion of the structure. This device comprises a bag which may be inflated for assisting the taking off in the case in which the discoupling of the ballast alone is not sufficient for overcoming the friction forces between the penetrator and the sediments.

DETAILED DESCRIPTION OF THE INVENTION

If it is desired to guide the vehicle to a particular sea-bottom landing site, jet engines can be mounted on the structure, which allow the vehicle to be guided under the control of a sound navigation system.

The invention will now be described in more detail by means of a preferred embodiment and of the drawings.

Figure 1:
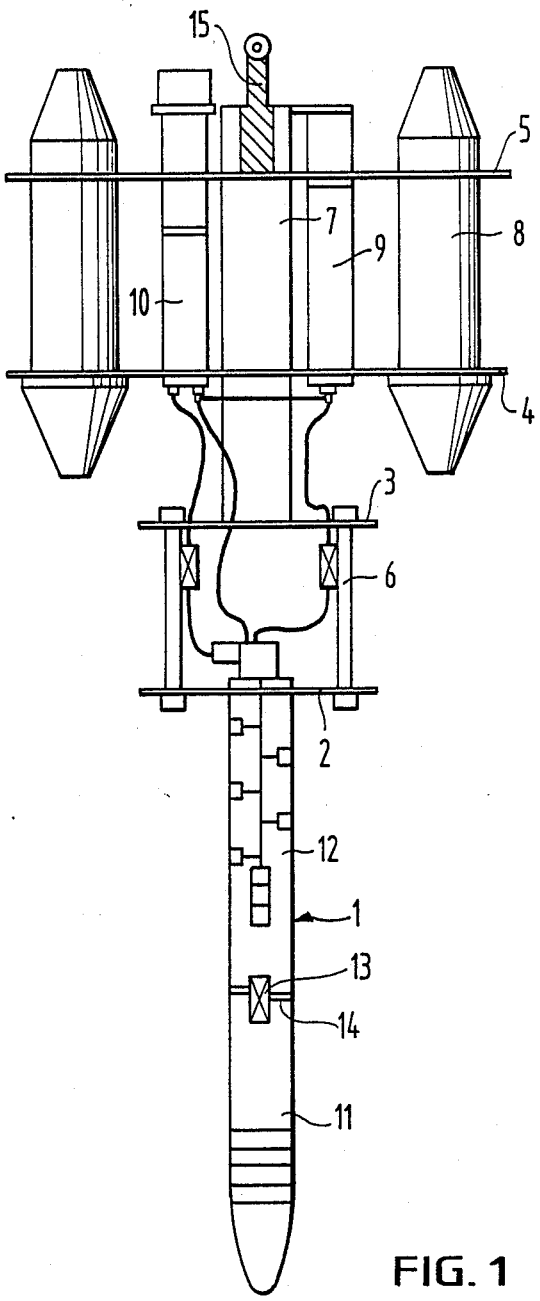
FIG. 1 shows this embodiment.

The vehicle shown in FIG. 1 comprises a penetrator 1 having a vertical axis, and a support structure fixed to the upper end of the penetrator. This structure includes four horizontal disks 2, 3, 4 and 5, the disk 2 being fixed to the upper end of the penetrator 1 and functioning as stop for the penetration movement into the sediment. This disk 2 and a second disk 3 make up a space for apparatus, instruments, batteries and so on. These two disks are interconnected via a plurality of bolts 6. The disk 3 is welded to a tube 7 which constitutes a link to the two upper disks 4 and 5. These disks 4 and 5 of a larger diameter support a plurality of float clusters 8 of substantially cylindrical shape which are spaced out regularly around the tube 7. They are made from a light material such as a syntactic foam and are used to mount the major part of the vehicle again to the surface after the measurements having been accomplished.

Between the central tube 7 and the float clusters 8, there still remains a space for measuring probes 9 intended to study the characteristics of the water directly above the sediment, and for a sound transmitter/-receiver 10 which is intended to ensure the bidirectional link with a similar transmitter/receiver at the ocean surface.

The penetrator 1 has a circular cylindrical shape and is composed of two parts 11 and 12, the lower part 11 with its rounded end constituting a ballast such that the vehicle may descend by gravity to the sea-bottom, whereas the upper part 12 is equipped at its outer surface with measuring probes. The part 12 is of a modular construction and can be placed in the sediment at a given depth. Control means are housed inside this upper part 12.

The two parts of the penetrator 1 are secured to each other by an explosive bolt 13 which can be released by a sound signal coming from the surface and received by the transmitter/receiver 10. By virtue of the explosion of the bolt 13, the two parts are separated along a separation line 14, and the upper part 12 is then pushed upwards by the float clusters 8 which are conceived for assisting the vehicle except the ballast 11 to take off and to mount to the ocean surface.

It would be possible to implement another means for assisting the taking off, if the combined upwards impact of the explosion of the bolt 13 and of the float clusters 8 were not enough for overcoming the friction forces retaining the upper part 12 of the penetrator in the sediment. This means can be a pyrotechnical device 15 which is mounted in the central tube 7 and cooperates with an inflatable bag. As soon as this device 15 is activated, the bag is inflated by a gas and by this means draws the vehicle upwards.

Figure 2:
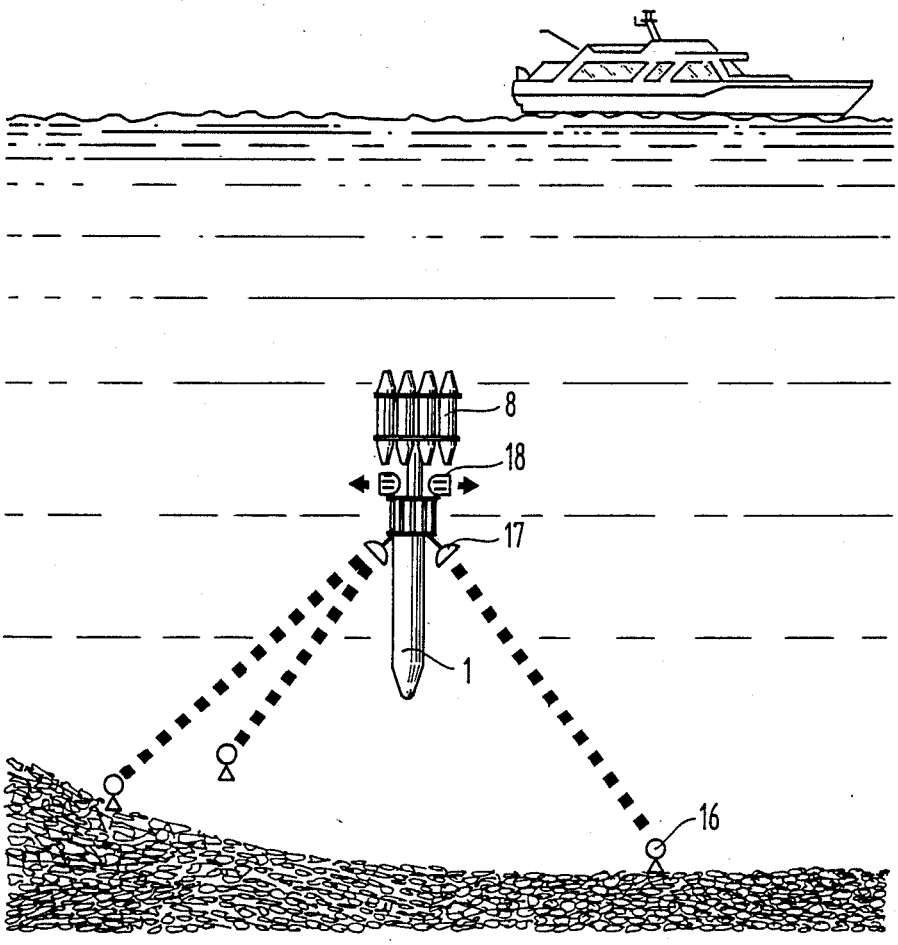
FIG. 2 represents the vehicle during its descending movement.

It is also possible to equip the vehicle with jet engines 18 (see FIG. 2), which may for example be mounted on the disk 3 and which are able to guide the vehicle towards a desired landing site. To this end, a sound navigation system is further provided, which is schematically shown in FIG. 2 and is based on several sound transmitters 16 and distance measuring probes 17 mounted on the vehicle.

The descent speed of the vehicle can be controlled by conveniently adjusting the weight of the ballast, thus allowing to predetermine the penetration depth into the sediment. There may moreover be provided jet engines which have a vertical impact and allow the descent speed to be controlled.

In order to indicate concrete ideas, the following detailed data are given concerning a prototype vehicle:

overall height: 4,5 m
height of the ballast part 11: 1 m
density of the float clusters: 0,6
density of the ballast: 7,8
weight of the ballast at the surface: 600 kg
weight of the payload (instrumentation): 350 kg The autonomy of the batteries is conceived to extend the experimental phase at the sea-bottom to several months.

I claim:

1. A submarine vehicle intended to measure data at the deep ocean sea-bottom, comprising a penetrator conceived to penetrate by gravity into the sediments at the sea-bottom, a support structure having a vertical axis and a plurality of float clusters disposed regularly around the axis of the support structure at the upper portion thereof, the penetrator being mounted at the lower end of said support structure and coaxially therewith, the penetrator being conceived to be divided into two cylindrical parts by means of a remotely controlled discoupling means, the lower one of said parts having a rounded end portion intended to penetrate into the sea-bottom and to constitute a ballast such that the vehicle may descend by gravity and at a given speed to the sea-bottom, whereas the upper one of said penetrator parts is conceived to receive a device for measuring data in the sediment, a transmitter/receiver for ultrasound signals being mounted between the float clusters in the upper portion of the support structure and being conceived to cooperate with a similar transmitter/-receiver at the free ocean surface, in order to transmit measuring data thereto and to receive control data therefrom, for example control data for discoupling the two parts of the penetrator.

2. A vehicle according to claim 1, wherein a horizontal disk is mounted on the upper end of said penetrator and serves to stop the penetration movement of the vehicle into the sediments.

3. A vehicle according to claim 1, wherein a remotely controlled pyrotechnical device is mounted at the upper portion of said structure and comprises a bag which may be inflated in order to assist the vehicle in taking off.

4. A vehicle according to claim 1, wherein a set of jet engines mounted on said structure allows the vehicle to be directed towards a desired landing site under the control of a sound navigation system.

* * * * *